United States Patent [19]

Tellie

[11] 3,939,589

[45] Feb. 24, 1976

[54] FIREARMS WITH FORESTOCK

[76] Inventor: Paul E. Tellie, 20, rue Bergson-42000, St. Etienne, France

[22] Filed: May 17, 1974

[21] Appl. No.: 470,840

[30] Foreign Application Priority Data

June 1, 1973 France ..... 73.1995

[52] U.S. Cl. ..... 42/71 R; 42/1 S; 42/75 A; 42/75 C

[51] Int. Cl.[2] ..... F41C 23/00; F41G 1/46

[58] Field of Search..... 42/71 R, 75 A, 75 C, 1 S, 42/75 B

[56] References Cited

UNITED STATES PATENTS

| | | | |
|---|---|---|---|
| 3,090,150 | 5/1963 | Stoner | 42/71 R |
| 3,323,246 | 6/1967 | Loffler | 42/75 A |
| 3,512,290 | 5/1970 | LaViolette, Jr. et al. | 42/75 A |
| 3,604,137 | 9/1971 | Silsby | 42/1 S |
| 3,742,636 | 7/1973 | Dealy et al. | 42/1 S |

*Primary Examiner*—Charles T. Jordan
*Attorney, Agent, or Firm*—Stevens, Davis, Miller & Mosher

[57] ABSTRACT

A firearm having a launching tube the rear portion which is surrounded by a forestock serving as support for the launching tube. The forestock is formed of two parts which are removable independently of each other. One part is a lower housing which serves as support for certain firing mechanisms, such as the trigger mechanism. The lower housing is fastened by screws to the launching tube and breech housing of the firearm. The other part is an upper hood which protects accessory mechanisms present in the upper region of the firearm, such as sighting and recocking devices. The upper hood is fastened by screws to the launching tube.

8 Claims, 5 Drawing Figures

FIREARMS WITH FORESTOCK

The present invention relates to firearms, and particularly to automatic firearms, comprising a launching tube borne by a mount (called "forestock") surrounding the entire rear portion of the said launching tube and serving as support for certain accessory mechanisms (trigger system, recocking device, sling rings, for instance), the said mount being extended towards the rear by a buttstock in the case of a firearm which is to be fired from the shoulder by the marksman.

Although the invention may be applied to firearms of all calibers, its application seems to be of more particular interest in the case of firearms of small caliber, particularly firearms of the portable type which are capable of being fired from the shoulder by the marksman, which is true of assault rifles and machine pistols in particular.

The object of the present invention is to provide a firearm with a forestock, the forestock of which can be easily dissociated from the active parts of the firearm (tube and breech mechanism).

Another object of the invention is to provide a portable firearm with a forestock which can be conveniently transported.

Still another object of the invention is to provide a firearm with a forestock, some of the accessory parts of which (in particular sighting and recocking members) are effectively protected against possible blows from the outside.

Still another object of the invention is to provide a firearm with a forestock which lends itself to effective instinctive rapid sighting without the marksman having to have recourse to the normal sighting devices with which the firearm is provided.

The firearm in accordance with the invention is a firearm (generally automatic and in particular of a portable type with buttstock adapted to be brought to the shoulder) comprising a launching tube the rear portion of which is surrounded by a forestock serving as support for said launching tube, the said firearm being characterized by the fact that its forestock is formed essentially of two separate parts which are removable independently of each other, namely:

on the one hand, a lower part, hereinafter called "housing" serving as support for certain secondary mechanisms of interest to firing, particularly the trigger mechanism for the firearm, the housing being preferably fastened by removable attaching means to the launching tube and to the breech housing of the firearm, and, on the other hand, an upper portion, hereinafter called "hood", adapted to protect the accessory mechanisms present in the upper region of the firearm, and in particular sighting and recocking devices, the said hood being preferably secured by removable attaching means to the said launching tube.

As a result of this arrangement, the marksman will have the possibility:

either of having access to these secondary mechanisms which are located in the upper region of the firearm by seizing the said firearm by the housing of the forestock which has remained in place and removing the hood from said forestock, or of removing the housing from the forestock in order to have access to the annexed mechanisms borne by the said housing, while leaving the hood of the forestock in place, it then continuing to play its protective role.

Preferably, in the case of a portable firearm, the hood of the forestock of the firearm is arranged in such a manner as to constitute a carrying handle enabling the marksman to carry the weapon.

Furthermore, the hood of the forestock of the firearm preferably comprises at its upper portion a channel which is open towards the top and parallel to the axis of the tube of the firearm, the said channel defining a sort of "sighting channel", which is less precise, of course, than the line of sight determined by the sighting means of the firearm, but nevertheless permitting a rough sighting under circumstances in which the marksman must act very rapidly by a practically instinctive reflex.

If it is desired, as is obviously advantageous, that the hood of the forestock of the firearm can at the same time protect the sighting devices of the firearm, act as carrying handle and have at its upper part a channel forming the sighting channel, the hood can advantageously be provided with:

a longitudinal base in the form of an inverted channel, adapted to fit over the upper portion of the firearm proper at the rear region of the launching tube, two hoops forming a carrying handle, extending above the said base parallel to the longitudinal plane of symmetry of the hood in question, these two hoops each comprising two end uprights (a front upright and a rear upright) connected by a flat upper strip directed vertically and extending parallel to the axis of the launching tube, and a transverse partition connecting, over at least the major portion of their length, the lower edges of the flat upper strips of the two hoops, the said transverse partition defining with the said upper strips a channel open towards the top which forms a sighting channel.

When the sighting device of the firearm comprises a rear member such as a peephole and a front member such as a front sight, the supports of the said rear and front members can then advantageously be housed between the rear and front uprights respectively of the two handle-forming hoops, the said uprights protecting the supports in question and the corresponding sighting members from accidentally having their adjustment changed.

It should be noted that this latter arrangement makes it possible to use relatively high, stationary sighting-member supports (in contradistinction to swingable sighting-member supports) which have the advantage of being always ready for use without any prior manipulation, the supports being preferably fastened directly on the working parts of the firearm.

One can then advantageously have the transverse partition connecting the two hoops extend over the entire length of the upper strips of said hoops and extend the said partition, to the front and the rear, by two vertical partitions, one of which connects the front edges of the rear uprights together and the other of which connects the rear edges of the front upright together. In this way two vertical channels are established which are open towards the rear and towards the front respectively, and connect with the two ends of the upper sighting channel.

When the firearm comprises a recocking member which protrudes above the rear portion of the launching tube, the said member may advantageously, in the event that the hood of the forestock of the firearm has a base on which there are hoops, extend in height beyond the upper wall of the said base, passing through a longitudinal opening provided for this purpose in the said upper wall, the said cocking member being thus free to slide while being protected against accidental blows by the said hoops.

When the firearm is to be able to be used for the firing of anti-personnel grenades with curved fire (such a use then taking place by aiming the weapon at a height of about 45° with its trigger directed toward the marksman, that is to say, with its super-structures directed towards the ground) and when the forestock of the same firearm comprises a hood with hoops, one can advantageously provide the firearm in question with at least one grenade-launching sighting system comprising a front sight borne by one of the hoops of the said hood and a peephole borne laterally (on the side of the hoop bearing the front sight) by the housing of the said forestock, the line of sight determined by the front sight and said peephole forming, at least approximately, an angle of about 45° with the axis of the launching tube.

If necessary the continuity of the grenade-launching line of sight defined by the front sight and the peephole can be assured, at the level of the base of the hood, by an opening provided in the floor of a lateral recess provided in the side wall of the said hood located on the front-sight side.

Finally, mention should be made that the two component parts of the forestock of the forearm (housing and hood) can advantageously be formed of a molded synthetic material, and advantageously of a laminated material having a base of fibers and of synthetic resin.

In order to illustrate the various arrangements which have just been mentioned, a preferred (but in no way limitative) embodiment of the invention will now be described with reference to the accompanying drawings in which:

FIG. 1 shows diagrammatically in perspective, and with its forestock shown in removed position, an assault rifle developed in accordance with the invention, FIG. 2 shows, under the same conditions, the said assault rifle with its forestock mounted, FIG. 3 shows, in end view, the sighting device of this assault rifle, FIG. 4 shows schematically the said assult rifle in position of firing for the launching of grenades, and FIG. 5, finally, is a partial side view on a larger scale of the said assault rifle shown in this same position of firing for the launching of grenades.

DESCRIPTION OF THE PREFERRED EMBODIMENTS

Figure 1:
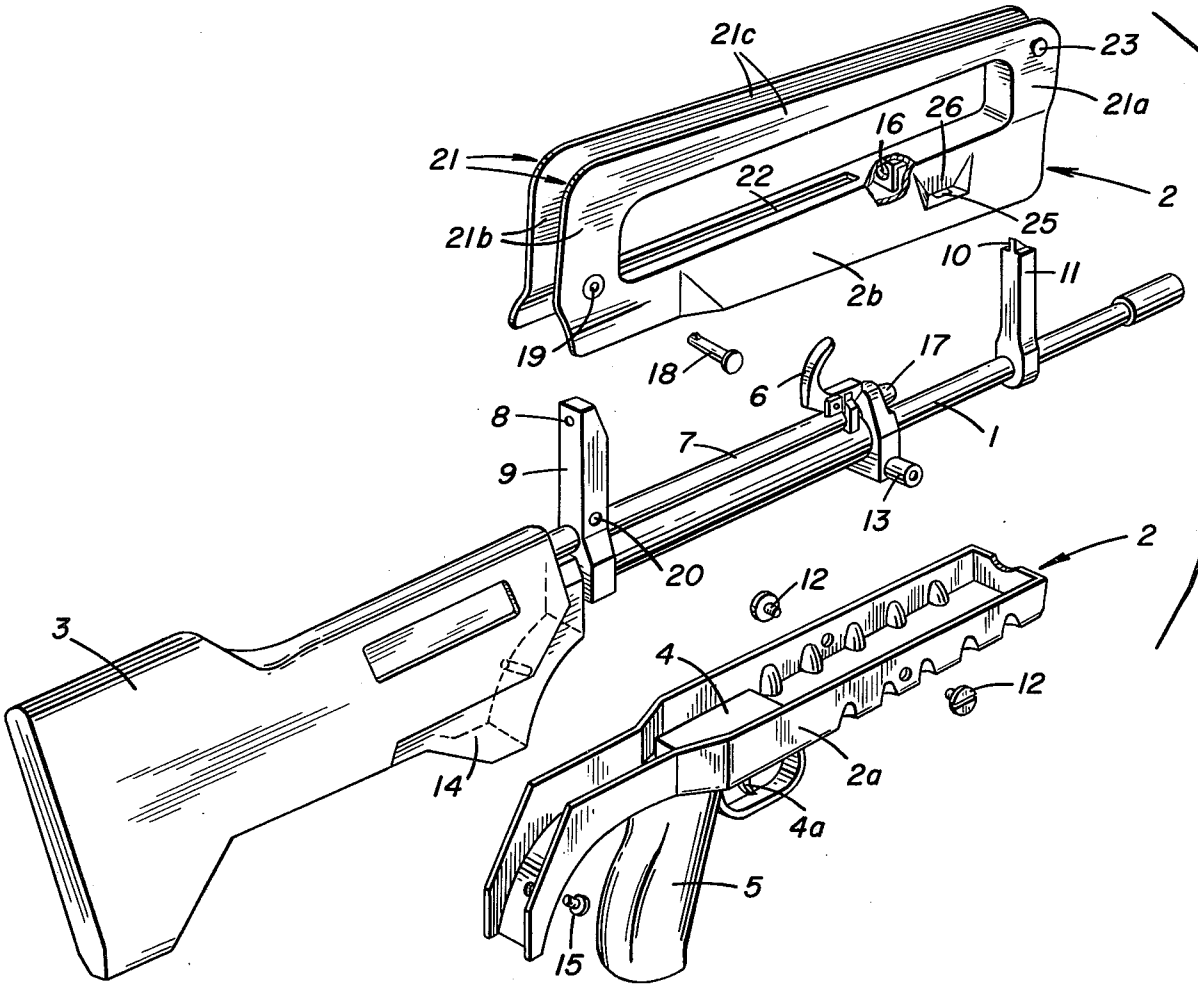
Figure 2:
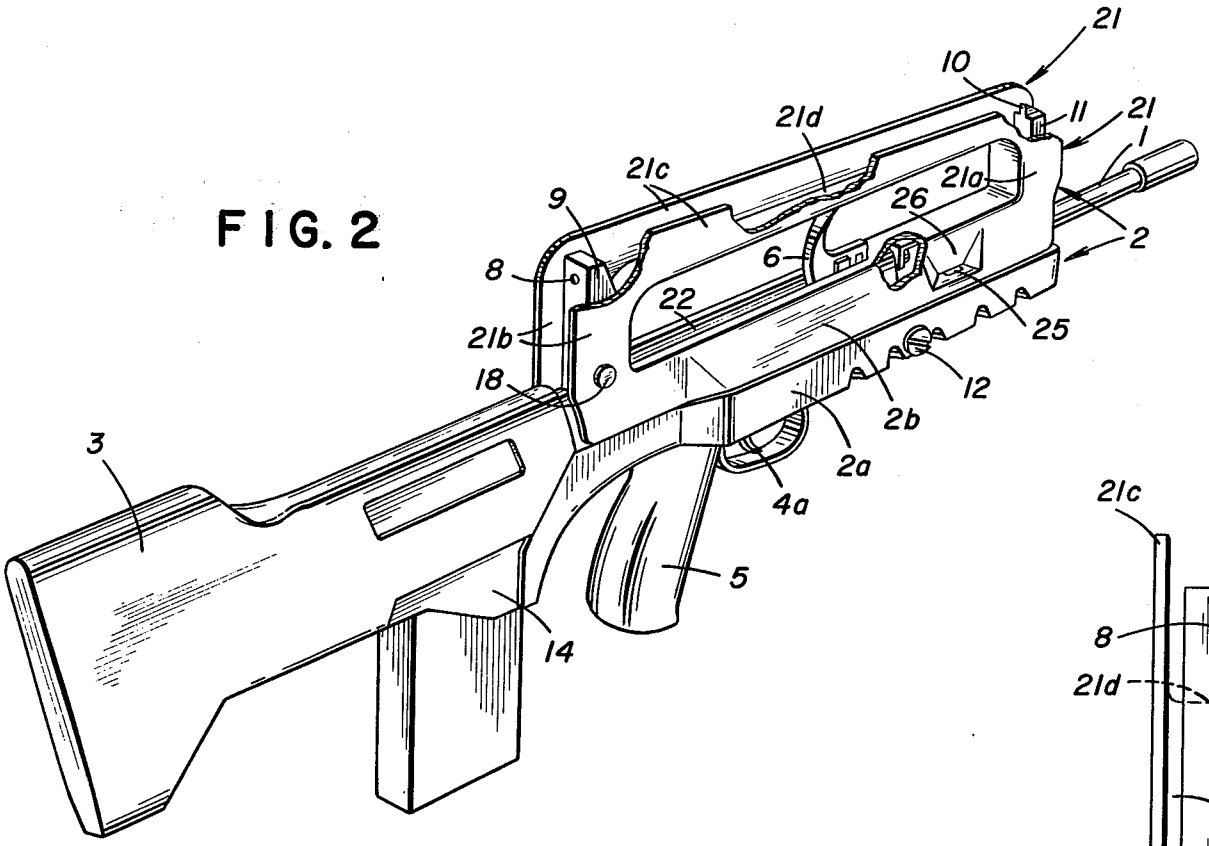

The automatic firearm shown in forestock-removed view in FIG. 1 and in forestock-mounted view in FIG. 2 is an assault rifle comprising a launching tube 1 the rear portion of which is surrounded by a forestock 2 serving as support for the tube 1. The forestock 2 is extended towards the rear by a buttstock 3 which the marksman can bring to his shoulder.

In accordance with the invention, the forestock 2 of this weapon is formed of two separate parts which are removable independently of each other, namely:

on the one hand, a lower housing 2*a* serving as support for the trigger mechanism 4 of the weapon, the trigger 4*a* proper, and a pistol grip 5, and, on the other hand, an upper hood 2*b* adapted to protect a recocking level 6 controlling a recocking rod 7 and sighting members such as a peephole 8 borne by a support 9 and a front sight 10 borne by a support 11, the said supports 9 and 11 being firmly connected to the launching tube 1 and extending vertically up from said tube 1.

The housing 2*a* is fastened removably on the one hand towards the front to the launching tube 1 by two screws 12 adapted to be screwed into a threaded transverse rod 13 rigidly connected with said tube 1, and on the other hand towards the rear to the support 14 of the breech mechanism by a screw 15, the said support 14 being rigidly connected with the buttstock 3 of the weapon.

As for the hood 2*b*, it is fastened removably to the launching tube 1 on the one hand by the engagement, in a case 16 borne by said hood, of a stud 17 which is rigidly connected with the tube 1, and on the other hand by the engagement of an elastic locking pin 18 in facing orifices 19 and 20 provided in the side walls of the hood 2*b* and in the base of the support 9 of the peephole 8 respectively (which support is rigidly connected with the launching tube 1).

The hood 2*b* comprises essentially:

a longitudinal base adapted to fit over the upper portion of the weapon proper at the rear region of the tube 1. The base, which constitutes the main element of the hood, being indicated for this reason in FIGS. 1 and 2 by the reference number 2*b* which up to now designated the entire hood, two hoops 21 forming a carrying handle, extending above the base and each comprising a front upright 21*a* and a rear upright 21*b* connected by an upper strip 21*c* parallel to the tube 1, the said uprights and the said strip being formed of a single flat piece whose plane is directed vertically, and a transverse partition 21*d* connecting the lower edges of the bars 21*c* and having at its two ends extensions 21*e* (one of which is visible in FIG. 3) which are bent back at a right angle and connect the uprights of the same nature (front or rear) of the two hoops 21.

Figure 3:
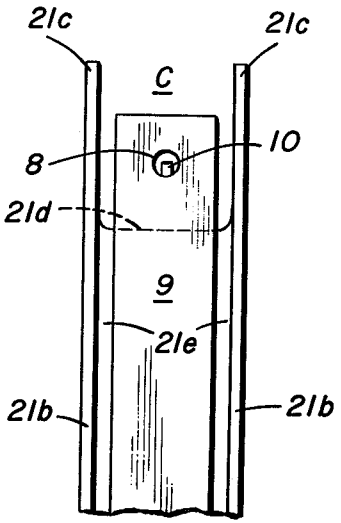

The transverse partition 21*d* and the strips 21*c* define a sighting channel C into which the peephole 8 and the front sight 10 protrude, as can be noted from FIG. 3, the support 9 of the said peephole being protected laterally by the two rear uprights 21*b* and towards the front by the rear extension 21*e*, while the support 11 of the front sight 10 is protected laterally by the two front uprights 21*a* and towards the rear by the front extension 21*e*.

A longitudinal opening 22 is provided in the upper wall of the base of the hood 2*b* for the passage of the recocking lever 6 which is thus protected by the two hoops 21 and the transverse partition 21*d*.

Figure 4:
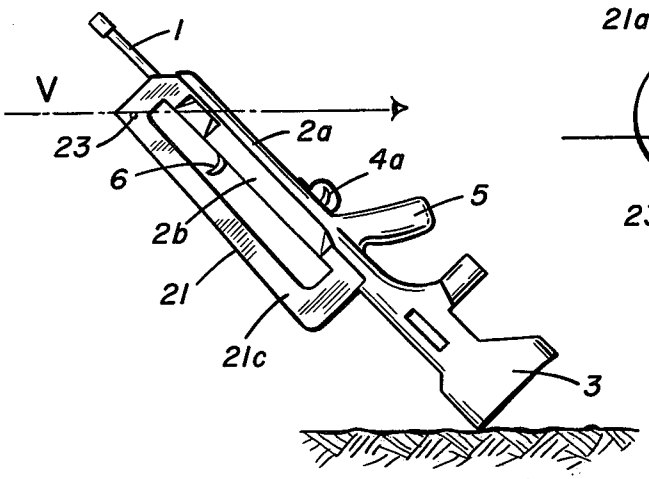

In FIG. 4 (in which the same reference numbers designate the same parts as in FIGS. 1 to 3) the assault rifle is shown in mortar-firing position. The rifle is inclined approximately 45° with its housing 2*a* turned towards the marksman, the buttstock 3 resting on the ground.

Figure 5:
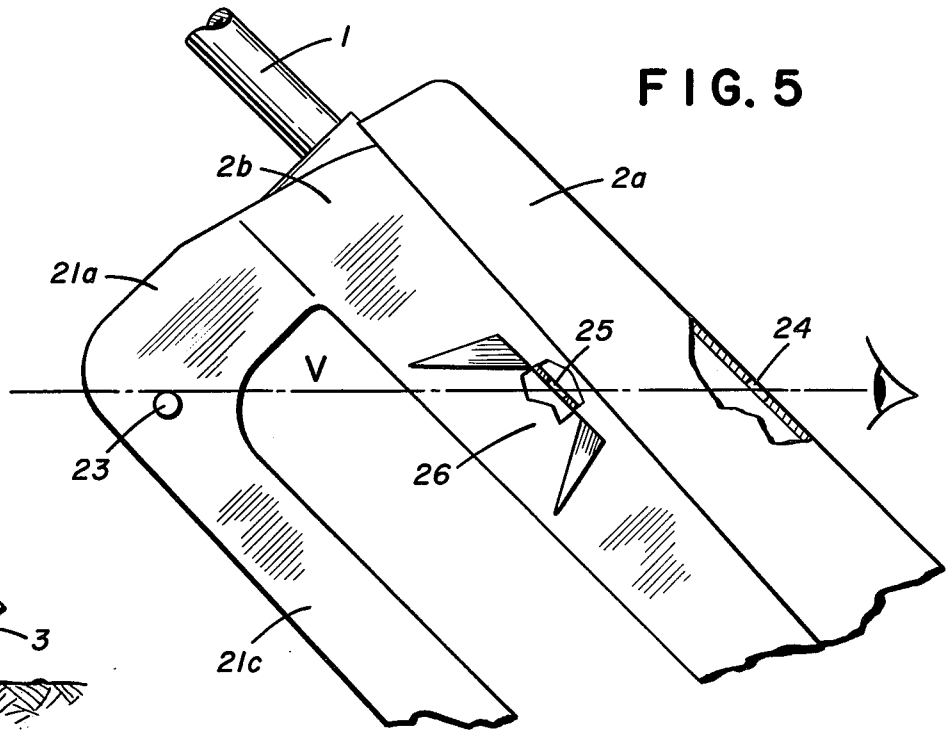

The assault rifle in question is provided, for the firing of mortars, and as shown in greater detail in FIG. 5, with a special sighting system which comprises:

a front sight 23 borne by the outer wall of the front end of one of the strips 21*c*, a peephole 24 provided in the floor of the housing 2*a* on the same side as the front sight 23, and an opening 25 provided in the floor of a lateral recess 26 provided in the side wall of the hood 2*b* located on the same side as the front sight 23, the said opening making it possible to establish continuity of the line of sight V defined by the front sight 23 and the peephole 24, as clearly visible in FIG. 5.

Finally, it should be pointed out that the housing 2*a*, the hood 2*b* and the buttstock 3 are formed of a laminated material having a base of fibers and synthetic resin.

As goes without saying, and as furthermore is evident already from the foregoing, the invention is in no way limited to that one of its methods of application, nor to those of the embodiments of its various parts which have been more particularly indicated; rather, it covers all variants.

What is claimed is:

1. A firearm comprising:

a breech housing, a launching tube, a forestock, said forestock surrounding the rear portion of said launching tube, said forestock comprising:

a lower housing portion for supporting firing mechanisms, said housing portion being fastened by removable fastening means to the launching tube and to the breech housing, an upper hood portion for protecting mechanisms in the upper region of the firearm, said hood portion being fastened by removable fastening means to said launching tube, said hood portion comprising:

a longitudinal base in the form of an inverted channel adapted to come over the upper portion of the firearm near the rear region of the launching tube, two hoops forming a carrying handle permitting a marksman to carry the firearm, said hoops extending above said base and the two hoops each comprising a front upright and a rear upright connected together by a flat upper strip which is directed vertically and extends parallel to the axis of the launching tube, and a transverse partition connecting the lower edges of the upper strips of the two hoops at least over the major portion of their length, said transverse partition together with the upper strips defining a channel which is open towards the top, is parallel to the axis of the tube, and forms a sighting channel, and said upper portion and said lower portion are two separate parts which are removable independently of each other.

2. A firearm as claimed in claim 1, further comprising a sighting device comprising a rear peephole and a front sight, said peephole having a support, said front sight having a support, the support of the peephole being housed between the rear uprights of the hoops of the hood portion, the support of the front sight being housing between the front uprights of said hoops, and said supports being mounted in fixed position and said peephole and said front sight protruding into the sighting channel.

3. A firearm as claimed in claim 2, wherein:

the transverse partition connecting the two hoops of the hood portion extends over the entire length of the upper strips of said hoops and is extended, at the front and the rear, by two vertical partitions which connect together the two front uprights and the two rear uprights respectively.

4. A firearm as claimed in claim 3 further comprising, a recocking member protruding above the rear portion of the tube, said member protruding above the base of the hood portion of the forestock, and said base has a longitudinal opening permitting the passage and sliding of said recocking member.

5. A firearm as claimed in claim 4 wherein:

the lower housing portion and the upper hood portion of the forestock are made of a molded synthetic material.

6. A firearm as claimed in claim 5 wherein:

said material is a laminated material having a base of fibers and synthetic resin.

7. A firearm as claimed in claim 1 comprising a sighting device for the launching of grenades, said sighting device comprising a front sight borne by one of the hoops of the hood portion of the forestock and a peephole borne laterally by the housing portion of said forestock, and the line of sight is defined by said front sight and said peephole forming, at least approximately, an angle of the order of 45° with the axis of the launching tube.

8. A firearm as claimed in claim 7 comprising:

a recess in the side wall of the base of said hood portion on the same side as said front sight, a floor in said recess, and an opening in said floor for assuring the continuity of the line of sight defined by the front sight and the peephole.

* * * * *